United States Patent [19]

Portz et al.

[11] Patent Number: 4,707,193

[45] Date of Patent: Nov. 17, 1987

[54] METHOD FOR ACTIVATING METAL SURFACES PRIOR TO ZINC PHOSPHATION

[75] Inventors: Heinz Portz, Roesrath; Reinhard Opitz, Duren, both of Fed. Rep. of Germany

[73] Assignee: Gerhard Collardin Gesellschaft mit beschraenkter Haftung, Cologne, Fed. Rep. of Germany

[21] Appl. No.: 933,832

[22] Filed: Nov. 24, 1986

[30] Foreign Application Priority Data

Nov. 28, 1985 [DE] Fed. Rep. of Germany ..... 3541997

[51] Int. Cl.[4] ..... C23C 22/80; C23C 22/12

[52] U.S. Cl. ..... 148/6.15 Z; 148/6.15 R

[58] Field of Search ..... 148/6.15 R, 6.15 Z

[56] References Cited

U.S. PATENT DOCUMENTS

| | | | |
|---|---|---|---|
| 3,795,548 | 3/1974 | Hauser | 148/6.15 Z |
| 4,265,677 | 5/1981 | Mueller et al. | 148/6.15 Z |
| 4,384,900 | 5/1983 | Gotta et al. | 148/6.15 R |

FOREIGN PATENT DOCUMENTS

| | | | |
|---|---|---|---|
| 1287892 | 1/1969 | Fed. Rep. of Germany . | |
| 2232067 | 5/1980 | Fed. Rep. of Germany . | |
| 3213649 | 10/1983 | Fed. Rep. of Germany . | |
| 878307 | 9/1961 | United Kingdom | 148/6.15 Z |

*Primary Examiner*—Sam Silverberg

*Attorney, Agent, or Firm*—Ernest G. Szoke; Henry E. Millson, Jr.; Mark A. Greenfield

[57] ABSTRACT

A method for activating a metal surface during a phosphating process by treating the surface with an activating solution containing titanium ions, phosphate ions, and borate ions, after initial cleaning and rinsing but before phosphation.

24 Claims, No Drawings

METHOD FOR ACTIVATING METAL SURFACES PRIOR TO ZINC PHOSPHATION

BACKGROUND OF THE INVENTION

1. Field of the Invention

The invention relates to an improved method for activating metal surfaces made of iron, steel, zinc, or galvanized iron or steel, aluminum, aluminized steel, and various alloys of the foregoing, respectively, prior to the phosphation of said surfaces with phosphating baths containing zinc ions, more specifically prior to low-zinc phosphation.

2. Statement of Related Art

Methods for producing phosphate layers on iron and steel surfaces by means of acidic solutions containing phosphates of polyvalent metals as well as oxidants or other accelerator components required for phosphating have long been known. Such methods are used in the manufacture of car bodies in the automotive industry to an increasing extent in order to provide improved protection from corrosion for the iron materials or steel sheets, as commonly used in the automobiles. More recently, however, electrolytically galvanized and hot-dip galvanized steels are more frequently being used in car body manufacture, while, in addition to zinc alone, zinc alloys containing iron, nickel, cobalt or aluminum as alloy coingredients are gaining increasing acceptance as surface coatings prior to phosphation.

Prior to the application of a varnish onto the aforementioned metal surfaces, which application is usually effected by electro-dipcoating today, it is common practice to clean, rinse with water and then to phosphate the work-pieces. In known phosphating methods, it is possible in a single process step to rid the metal surfaces of adhering oil, grease and other physical contaminations and at the same time to activate them for the subsequent step of zinc phosphating. The cleaning, degreasing and activating solutions are usually applied onto the metal surfaces to be treated in a spray, dip or combined spray-dip procedure. The solutions are adjusted to from a weakly acidic to alkaline pH, and contain surfactants (wetting agents, emulsifiers), builder substances (sodium hydroxide, alkali metal carbonates, alkali metal phosphates) and, optionally, silicates and borate as well as substances having layer-attenuating and activating effects, for example titanium compounds such as titanium phosphates. Such aqueous solutions, which simultaneously display cleaning and activating effects, have been described as within the scope of methods for the pre-treatment of metal surfaces prior to the phosphation thereof in U.S. Pat. No. 4,384,900 (and corresponding German Pat. No. 2,951,600) and German Pat. No. 3,213,649.

In published German patent application 12 87 892 there has also been disclosed the use of aqueous alkaline solutions containing an alkali borate, wetting agents and/or activators, which preferably are free from silicate, for treating iron and steel surfaces prior to phosphating them with a zinc phosphate solution.

Such alkali borate solutions make possible combining the steps of cleaning, degreasing and activating and are usually applied by spraying. This is why they contain little foaming surfactant, thus avoiding excessive foam formation.

However, most recently there have been increasingly put into use low-zinc phosphating processes such as described in U.S. Pat. No. 4,265,677 (and corresponding Canadian Pat. No. 1,134,246), as well as in published German patent application No. 22 32 067. These enable distinctly improved protection from corrosion to be achieved by the usual electro-dipcoating. Such low-zinc phosphating processes respond much more sensitively to alterations in the process parameters and to contaminations introduced into the phosphating bath with the sheets to be coated. As a result, the step of activating the metal surface becomes of much greater importance. For eliminating drawbacks in the activation of the metal surfaces it has proven to be advantageous to divide the activating step from the cleaning and degreasing step. This is all the more applicable where the phosphating solution in the low zinc phosphating process is to be applied by a dipping procedure.

Stabilizing the separate activating bath constitutes a problem which to date has not yet been satisfactorily solved. Specifically, in contrast to combined cleaning-/degreasing/activation, no stable activating baths can be provided which enable a sufficiently good activation of the metal surfaces to be achieved by the phosphating step over an extended period of time.

Destabilization of the activating baths is caused by entrained "hardness constituents" (electrolytes) of the rinsing water which are carried over into the activating baths from the rinsing baths conducted between the cleaning and activating steps. Such destabilization can be avoided by various routes. For example, fully deionized water can be used for the rinsing step. However, this measure would drastically increase the total cost of the process. If tap water is used in the intermediate rinsing step, the varying water hardnesses have to be taken into account. This necessitates adapting the recipe of the activating bath to the respective conditions in water supply. Thus, in response to the actual tap water conditions, conventional softeners such as phosphates, EDTA, nitrilotriacetate, citrate and/or diphosphonylated organic compounds have to be added. However, the need for continually adapting the recipe of the activating bath to the actual process parameters by itself renders this process uneconomical. Moreover, the use of tap water in the rinsing bath significantly reduces the useful life of the activating bath.

In addition in practical operation (i.e. in sequential process steps of cleaning, rinsing, activating, rinsing and subsequent phosphating), it has been observed that upon operating for an extended period of time the activation effect is relatively rapidly reduced, which gives rise to an increase in the layer weight of the phosphate layer being formed. The layer weights are low in the beginning, but after an extended period of operation increase to values which are technologically undesirable. This requires the activating bath to be permanently controlled and/or replenished.

Moreover, it was observed again that the phosphate layers formed in the subsequent phosphation had discolored stripes and spots indicating an insufficient and/or poor activation of the metal surfaces.

Furthermore, the quality of the zinc phosphate layer applied by phosphation is sufficient only within very narrow limits of the free acid contents in the phosphating bath, which limits in practical operation are sometimes hard to realize. Zinc phosphate layers could be obtained which formed a good base for the subsequent electro-dipcoating procedure only if the free acid content of the phosphating solution was maintained within narrow limits by the addition of alkali. The low acid content also results in an increased sludge production in the bath.

The drawbacks as mentioned were particularly clearly apparent in the low-zinc phosphation of zinc or galvanized surfaces such as those being recently used in the manufacture of car bodies. More specifically, the formation of white spots which were observed upon poor activation resulted in a defective coating.

DESCRIPTION OF THE INVENTION

Other than in the operating examples, or where otherwise indicated, all numbers expressing quantities of ingredients or reaction conditions used herein are to be understood as modified in all instances by the term "about".

The present invention provides a bath which is stable against the influences mentioned above, for the separate activation of surfaces prior to a zinc phosphation, more specifically a low-zinc phosphation. The inventive bath not only allows the phosphation of metal surfaces to be rapidly and economically effected, but also increased corrosion protection to be obtained by the subsequent phosphation. In addition, the inventive activating bath enables the relatively narrow limits of the process parameters for the subsequent phosphation to be broadened and, more specifically, the free acid content in the subsequent phosphating bath to be maintained within wider limits than before. It was especially desired to realize these advantages with steel surfaces. In addition, due to a special activation the sludge formation in the subsequent phosphating step was reduced and, thus, a longer useful life of the phosphating bath was attained.

Unexpectedly it was now found that the above advantages are attainable simply by adding to the separate activating solutions one or more borate ions in addition to titanium ions and phosphate ions.

The invention thus affords a method for activating metal surfaces made of iron, steel, zinc, galvanized iron or steel, aluminum or aluminized iron or steel, and various alloys of the foregoing, which is employed between the steps of cleaning/rinsing and zinc (preferably low-zinc) phosphating. The invention utilizes aqueous alkaline solutions containing titanium ions and phosphate ions, and is characterized in that the activating solutions are adjusted to a pH of 8 to 10, and in that disodium tetraborate and/or other soluble alkali metal or alkaline earth metal borates are added thereto in such amounts that the weight ratio of $PO_4$: borate is 1:more than 1, based on $B_2O_7$. That is, the borate ions are present in a greater amount by weight than the phosphate ions.

Prior to the activation according to the invention, cleaning and degreasing solutions having conventional compositions can be employed. These solutions usually have a pH of 6 to 13 and conventionally contain at least one builder such as phosphates, carbonates, silicates or alkali metal hydroxides, and corresponding ammonium salts. Further components of the cleansing agent solutions are at least one conventional anionic and/or nonionic wetting agent, or at least one emulsifier such as addition products of ethylene oxide to fatty alcohols, alkylphenols, fatty amines or polyoxypropylene glycols. Condensed phosphates or other complexing agents are also usually employed as builder materials in the cleansing agent solutions. These may include hydroxypolycarboxylic acids such as citric acid, nitrilotriacetic acid, or ethylenediamine tetraacetic acid, phosphonic acids, or other conventional complexing agents.

The activation of the metal surfaces to be treated is effected separately with stock solution bases containing titanium ions and phosphate ions as components as already known from the prior art. The preparation of such stock solutions is also known in the art.

The activating solutions used in the method according to the invention contain titanium ions in amounts of up to 100 ppm. Usually the content is within the range between 1 and 100 ppm, a range of from 1 to 20 ppm being preferred. It is of particular advantage in the process according to the invention to use activation solutions containing titanium ions in amounts of from 1 to 10 ppm.

The contents of phosphate ions may be up to 3,000 ppm. Usually it is within the range of from 100 to 3,000 ppm and preferably within the range of from 200 to 1,500 ppm. It is of particular advantage to use activation solutions containing phosphate ions in amounts of from 200 to 600 ppm.

In the method according to the invention the pH of the activating solutions is adjusted to a range of from 8–10, preferably 8.5–9.5. According to the invention this range must neither be exceeded nor be fallen below, respectively, since at pH values of less than 8 or of more than 10 a satisfactory activation of the metal surfaces is impossible. Falling short of the pH lower limit will result in that the phosphate layers formed are no longer continuous and/or the layer weight thereof undesirably increases. Exceeding the pH upper limit in the same manner leads to a distinct deterioration of the quality of the phosphated layers as subsequently applied. Furthermore, when outside the above pH range, a reduced useful life of the activating bath is to be expected, i.e. of that time in which the bath is performing effectively.

It is a critical aspect of this invention that the activating solutions, in addition to titanium ions and phosphate ions, contain at least one borate. Borate compounds useful in this invention must be water soluble, and are peferably selected from alkali metal borates and alkaline earth metal borates. Useful borates include: anhydrous borax or disodium tetraborate ($Na_2B_4O_7$) as well as other naturally occurring sodium borate minerals; boron pentahydrate ($Na_2B_4O_7.5H_2O$); borax ($Na_2B_4O_7.10H_2O$ or disodium tetraborate decahydrate); lithium tetraborate ($Li_2B_4O_7$) and its pentahydrate ($Li_2B_4O_7.5H_2O$); potassium metaborate ($KBO_2$); potassium tetraborate pentahydrate ($K_2B_4O_7.5H_2O$); magnesium borate ($MgO(BO_2)_2$) and its octahydrate ($MgO(BO_2)_2.8H_2O$) as well as naturally occurring magnesium borate minerals such as ascherite, camsellite, inderite, kotoite, kurnakovite, paternoite, pinnoite, and szaibelgite, and boracite which is a chloride and borate of magnesium ($Mg_3B_7O_{13}Cl$); and calcium borate ($CaB_4O_7$) as well as naturally occurring calcium borate minerals such as colemanite, ginorite, inyoite, meyerhofferite, pandermite and priceite. It should be emphasized that only borates which can be dissociate in the alkaline aqueous activating solution can be used in the method of this invention, and if any of the above forms of naturally occurring minerals are insoluble, they are hereby excluded from this invention.

More preferred borates are predominantly sodium or potassium borates such as disodium tetraborate, disodium tetraborate pentahydrate, disodium tetraborate decahydrate, and the corresponding potassium compounds.

Because of its availability, the most preferred borate is predominantly disodium tetraborate decahydrate (borax), which may contain varying amounts of other borates of the above-described types.

The amount of borate or borates added is within such a range that the ratio by weight of $PO_4$:borate or $PO_4$:-borates is 1:more than 1, based on $B_2O_7$. Thus, in the activating solutions used for the inventive method, there is always present an excess by weight of borate or borate ions over phosphate ions. The ratio by weight (which for merely computational purposes is always based on $B_2O_7$) is preferably 1:1.01–20, most preferably 1:2–10. That is, it is to be considered as particularly advantageous to employ a two- to tenfold excess by weight of borate over the employed amount of phosphate.

The temperature of the activating bath in general may be within the range of from 10° C. to 50° C., preferably 20° C. to 40° C., more preferably 25° C. to 30° C.

The activating solutions used in the method according to the invention may be applied by spraying, dipping or any combination thereof, onto the metal surfaces.

The application of the process according to the invention leads to distinct improvements in the activation of metal surfaces made of iron, steel, galvanized iron or steel, aluminum or aluminized iron or steel, and alloys of the foregoing. The activating baths are stable against the influence of any hardness constituents even when using tap water, and also cannot become destablized by introduced alkali or contaminations entrained by the metal surfaces to be activated. Hence, topping up the activating solutions with activating components and/or fully deionized water for maintaining the excellent activating ability is required only to the extent of refilling the bath volume lost due to treatment of larger amounts of metal.

The treatment of the metal surfaces by the activating method according to the invention further enables a faster and improved quality of phosphation of the metal surfaces to be achieved. In addition, it has been demonstrated that the dependence of the subsequent phosphation step on the amount of free acid is substantially reduced and, thus, the method is clearly less affected by the process parameters. For example, the free acid content in the subsequent phosphation step may vary within substantially broader limits, so that an addition of alkali into the method is essentially less frequently required. Moreover, sludge formation in the phosphating bath is significantly suppressed, which increases operating periods between maintenance stops.

For the following phosphation steps generally all phosphating baths based on zinc phosphate can be used which, if desired, may also contain other layer-forming cations. However, in particular the process according to the invention is suitable for a subsequent low-zinc phosphation such as that described, for example, in German Pat. No. 22 32 067. The phosphating solutions to be used therein are characterized by a ratio by weight of zinc to phosphate of 1:12–110.

Particularly good results were attained in the subsequent phosphation of zinc or galvanized surfaces. As a result of activation using the method according to the invention the protection from corrosion on zinc surfaces is significantly improved, and speck formation no longer occurs.

A surprising additional advantage results from the fact that the activating solution according to the invention due to its chemical composition exerts essentially less influence on the subsequent phosphating step. Thus, the activating solution, even if introduced by entrainment into the subsequent phosphating bath, acts as a buffer due to its contents of at least one borate, and does not deteriorate the performance of the phosphating solution.

The method according to the invention may optionally be carried out by using solutions which additionally contain further, conventional, components. As such there may be mentioned known additives such as polycondensed phosphates, citrates, salts of ethylenediamine tetraacetic acid (EDTA), nitrilotriacetates, etc. However, it is to be emphasized that these components are by no means necessary. Just eliminating these extra ingredients represents a desirable simplification as compared to previously used cleaning agent and activating solutions, and is therefore a preferred embodiment.

In the method according to the invention, there may optionally be inserted a step of rinsing with water after the activation step and before the phosphation step. However, such rinsing is not compulsory and does not appear to contribute to the advantageous effects of employing the separate activating method according to the invention. Thus, within the context of the invention it is preferred to let the phosphation step directly follow the activation step.

The invention is further illustrated by the following examples.

EXAMPLE 1

Example 1a according to the invention

Steel parts were cleaned by spraying at 52° C. with a commercially available alkaline cleaning solution, containing 6 g/l of $Na_2HPO_4$ and 0.1 g/l of a nonionic tenside (surfactant), for 2 min and rinsed with water. Then the parts were treated for 1 min by spraying at 25° C. with an aqueous activating solution containing the following components:

$PO_4$: 400 mg/l (0.4 g/l)
Ti: 6 mg/l (0.006 g/l)
$Na_2B_4O_7.10H_2O$ 3500 mg/l (3.5 g/l)
pH: 8.5.

Water having a hardness of 22° dH was used for making this solution.

Subsequently the steel parts were treated by spraying for 2 min at 48° C. with a phosphating bath, which bath had the following composition:

$PO_4$: 20.2 g/l
Zn: 1.0 g/l
$ClO_3$: 1.5 g/l
$NO_2$: 0.05 g/l
Points of free acid: 1.0
Points of total acid: 24.2.

The phosphated steel parts were then rinsed with water, after-rinsed with distilled water, and dried in a drying oven.

The phosphate layers formed were finely crystalline, continuous and very uniform. These excellent phosphate layers resulted even after an operation time of the bath for about 8 h. Topping-up of the activating bath was not required. The layer weight of the phosphate layers was 1.4 g/m$^2$.

Comparative Example 1b

This comparative example was carried out on the analogy of the preceding Example 1a according to the invention, however the activating solution was prepared without the addition of $Na_2B_4O_7.10H_2O$.

The phosphate layers formed were finely crystalline and continuous at the beginning. After about 4 h of operation time irregularities in the layer formation occurred: The phosphate layers became coarsely crystalline and were no longer continuous. They had a layer weight of 3.5 g/m$^2$.

Comparative Example 1c according to German application No. 12 87 892

Steel parts were cleaned for 2 min by spraying with an alkaline cleaning solution having the following composition:
$N_2B_4O_7.10H_2O$: 2 g/l
Nonionic wetting agent: 0.2 g/l
Titanium phosphate: 0.02 g/l.
Then the parts were rinsed with water.

Thereafter the steel parts were treated for 2 min by spraying at 48° C. with a phosphating solution having the following composition:
$PO_4$: 20.2 g/l
Zn: 1.0 g/l
$ClO_3$: 1.5 g/l
$NO_2$: 0.05 g/l
Points of free acid: 1.0
Points of total acid: 24.2.

Then the steel parts were rinsed with water, afterrinsed with distilled water and dried in a drying oven.

The phosphate layers formed were finely crystalline and continuous at the beginning. After about 4 h of operation time the phosphate layers became coarsely crystalline and were no longer continuous. The layer weight was 3.2 g/m$^2$.

The above Example 1a shows the advantages of the procedure according to the invention: Even after an extended time of operation there result phosphate layers which have a desired low layer weight. Contrary thereto, as seen from Examples 1b and 1c according to the prior art, after some time of operation there result qualitatively inferior phosphate layers, which, in addition, have a higher layer weight.

EXAMPLE 2

Example 2a according to the invention

Steel parts were cleaned by spraying for 2 min at 55° C. with a commercially available alkaline cleaning solution (containing 6 g/l of $Na_2HPO_4$ and 0.1 g/l of a nonionic tenside) and rinsed with water. Then the parts were treated by spraying for 1 min at 28° C. with an activating solution containing the following components:
$PO_4$: 800 mg/l (0.8 g/l)
Ti: 13 mg/l (0.013 g/l)
$Na_2B_4O_7.10H_2O$: 4300 mg/l (4.3 g/l)
pH value: 9.1.

In the preparation of this solution water having a hardness of 14° dH was used.

Then the parts were treated by spraying for 2 min at 52° C. with a phosphating bath which had the following composition:
$PO_4$: 19.0 g/l
Zn: 0.7 g/l
$ClO_3$: 1.8 g/l
n-Nitrobenzenesulfonic acid: 0.4 g/l
Points of free acid: 1.5
Points of total acid: 23.0.

The parts were subsequently rinsed with water, afterrinsed with distilled water and dried in a drying oven.

The phosphate layers formed were finely crystalline, continuous and very uniform. These excellent phosphate layers having a layer weight of 1.5 g/m$^2$ resulted even after an operation time of about 8 h. Topping-up of the activating bath was not required. Due to the procedure according to the invention the phosphating bath could be operated using a higher amount of free acid. This directly resulted in a reduced amount of sludge produced in the phosphating bath during the operation time.

Comparative Example 2b

This comparative example was carried out on the analogy of the preceding Example 2a according to the invention, however the activating solution was prepared without the addition of $Na_2B_4O_7.10H_2O$.

Now, with 1.5 points of free acid in the phosphating bath no phosphate layers could be formed. Only after reducing the free acid points with sodium hydroxide solution to 0.7 was a formation of satisfactory phosphate layers possible. However, after an operation period of about 3 h irregularities in the layer formation occurred: The resulting phosphate layers became coarsely crystalline and were no longer continuous; the layer weight was 3.0 g/m$^2$. The amount of sludge produced in the phosphating bath was about twice as much as in Example 2a according to the invention.

Comparative Example 2c according to German application No. 12 87 892

Steel parts were cleaned by spraying for 2 min at 60° C. with an alkaline cleaning solution having the following composition:
$Na_2B_4O_7.10H_2O$: 2 g/l
Nonionic wetting agent: 0.2 g/l
Titanium phosphate: 0.02 g/l.

Then the parts were rinsed with water and thereafter treated by spraying for 2 min at 52° C. with the phosphating solution as described in Example 2a according to the invention.

No satisfactory phosphate layers resulted therefrom. Only upon reducing the free acid points from 1.5 to 0.7 did a satisfactory layer formation become possible. After an operation period of about 3 h irregularities in the layer formation occurred: The phosphate layers formed became coarsely crystalline and were no longer continuous; the layer weight was 3.4 g/m$^2$. The amount of sludge produced in the phosphating bath was about twice as much as in Example 2a according to the invention.

The preceding Examples 2a to 2c show the advantages of the method according to the invention: The subsequent phosphating bath may also be operated with high free acid points without losses in quality of the phosphate layers formed. This means that when the method is carried out according to the present invention, a very advantageously wider range of free acid points may exist in the subsequent phosphating bath. Furthermore, using the method according to the invention results in phosphate layers having a desirably lower layer weight. Moreover, a higher free acid content reduces incrustations on the heat registers of the phosphating bath, improving ease of maintenance and industrial usefulness.

EXAMPLE 3

Example 3a according to the invention

Electrolytically galvanized steel parts were cleaned by dipping for 3 min at 55° C. in to a commercially available alkaline cleaning solution (containing 20 g/l of $NaHCO_3$, 6 g/l of $Na_3PO_4$ and 4 g/l of a nonionic tenside) and rinsed with water. Then the parts were treated for 2 min by dipping at 20° C. into an activating solution containing the following components:

$PO_4$: 600 mg/l (0.6 g/l)
Ti: 15 mg/l (0.015 g/l)
$Na_2B_4O_7.10H_2O$: 5200 mg/l (5.2 g/l)
pH value: 8.9.

In the preparation of this solution water having a hardness of 4° dH was used.

Thereafter the steel parts were treated by dipping for 3 min at 55° C. into a phosphating bath, which bath had the following composition:

$PO_4$: 19.5 g/l
Zn: 1.3 g/l
$ClO_3$: 2.0 g/l
$NO_2$: 0.03 g/l
Points of free acid: 1.3
Points of total acid: 23.5.

The parts were subsequently rinsed with water, after-rinsed with distilled water and dried in a drying oven.

The phosphate layers formed were finely crystalline, continuous and very uniform; they had a layer weight of 2.5 g/m$^2$.

Comparative Example 3b

This comparative example was carried out on the analogy of the Example 3a according to the invention, however the activating bath was prepared without adding $Na_2B_4O_7.10H_2O$.

The phosphate layers formed in the subsequent phosphation were coarsely crystalline and not uniform; they had a layer weight of 4.5 g/m$^2$. Furthermore, on the surface there were observed very undesirable corrosion products in the form of white spots, presumably zinc oxide.

The preceding Examples 3a and 3b also demonstrate the advantages of the process according to the invention: The result for electrolytically zinc-coated steel parts treated according to the inventive method was a desirable layer weight of the phosphate layer; speck formation did not occur.

Comparative Example 4

Steel parts were cleaned by spraying for 2 min at 52° C. with an alkaline aqueous cleaning agent solution having the following composition:

5 g/l of $Na_2HPO_4$
0.04 g/l of a nonionic tenside.

Then parts were rinsed by spraying same with water and thereafter treated by spraying for 1 min at 23° C. with an activating solution, which solution contained the following components:

$PO_4$: 1200 mg/l (1.2 g/l)
Ti: 13 mg/l (0.013 g/l)
$Na_2B_4O_7.10H_2O$: 4300 mg/l (4.3 g/l).

The pH value of this solution was adjusted to 11.5 with sodium hydroxide solution, which pH is above the range of this invention. Water having a hardness of 14° dH was used for the preparation of this solution.

Then the parts were treated by spraying for 2 min at 52° C. with a phosphating bath, which bath had the following composition:

$PO_4$: 19.0 g/l
Zn: 0.7 g/l
$ClO_3$: 1.8 g/l
n-Nitrobenzenesulfonic acid: 0.4 g/l
Points of free acid: 1.5
Points of total acid: 23.0.

Thereafter the parts were rinsed by spraying them with water and dried in a drying oven. The phosphate layers formed were coarsely crystalline and not continuous; they had a layer weight of 3.5 g/m$^2$. This demonstrates the criticality of the upper pH range (10) according to this invention.

Comparative Example 5

This comparative example was carried out on the analogy of the preceding Comparative Example 4; however, the activating solution was adjusted with phosphoric acid to a pH value of 6.5, which pH is below the range of this invention. The phosphate layers formed were also coarsely crystalline and not continuous; the layer weight was 3.3 g/m$^2$. This demonstrates the criticality of the lower pH range (8) according to this invention.

We claim:

1. In a method for phosphating at least one metal surface comprised of iron, steel, zinc, galvanized iron or steel, aluminum, aluminized iron or steel, or alloys of the foregoing, in which said surface is (1) cleaned and rinsed, (2) subjected to an activating bath, and then (3) phosphated using a phosphating bath comprising zinc ions and phosphate ions in aqueous solution, the improvement comprising using as said activating bath an aqueous alkaline solution with a pH of about 8–10 consisting essentially of:

(A) at least one water soluble alkali metal borate or alkaline earth metal borate;
(B) titanium ions present in up to 100 ppm; and
(C) phosphate ions present in up to 3,000 ppm; wherein the weight ratio phosphate:borate (as $B_2O_7$) is 1:more than 1.

2. The method of claim 1 wherein said at least one borate is: a naturally occurring sodium borate mineral, disodium tetraborate, disodium tetraborate pentahydrate, disodium tetraborate decahydrate, lithium tetraborate, lithium tetraborate pentahydrate, potassium metaborate, potassium tetraborate pentahydrate, magnesium borate or a naturally occurring magnesium borate mineral, magnesium borate octahydrate, boracite, calcium borate or a naturally occurring calcium borate mineral, or a mixture thereof.

3. The method of claim 2 wherein said borate is predominantly at least one sodium borate.

4. The method of claim 2 wherein said borate is predominantly disodium tetraborate or disodium tetraborate decahydrate.

5. The method of claim 1 wherein said titanium ions are present in about 1–100 ppm.

6. The method of claim 1 wherein said titanium ions are present in about 1–20 ppm.

7. The method of claim 1 wherein said titanium ions are present in about 1–10 ppm.

8. The method of claim 1 wherein said phosphate ions are present in about 100–3,000 ppm.

9. The method of claim 1 wherein said phosphate ions are present in about 200–1,500 ppm.

10. The method of claim 1 wherein said phosphate ions are present in about 200–600 ppm.

11. The method of claim 1 wherein said phosphate:-borate weight ratio is about 1:1.01–20.

12. The method of claim 1 wherein said phosphate:-borate weight ratio is about 1:2–10.

13. The method of claim 2 wherein:

said titanium ions are present in about 1–20 ppm;

said phosphate ions are present in about 20–1,500 ppm; and said phosphate:borate weight ratio is about 1:1.1–20.

14. The method of claim 1 wherein the pH of said activating bath is about 8.5–9.5.

15. The method of claim 2 wherein the pH of said activating bath is about 8.5–9.5.

16. The method of claim 13 wherein the pH of said activating bath is about 8.5–9.5.

17. The method of claim 1 wherein the temperature of said activating bath is about 10°–50° C.

18. The method of claim 1 wherein said metal surface is rinsed between step (2) and (3).

19. The method of claim 1 wherein said metal surface is not rinsed between steps (2) and (3).

20. The method of claim 1 wherein at least one additive is included within said activating bath selected from polycondensed phosphates, citrates, EDTA salts, or nitrilotriacetates.

21. The method of claim 1 wherein said at least one metal surface is zinc, galvanized iron, or galvanized steel.

22. The method of claim 2 wherein said at least one metal surface is zinc, galvanized iron, or galvanized steel.

23. The method of claim 13 wherein said at least one metal surface is zinc, galvanized iron, or galvanized steel.

24. The method of claim 16 wherein said at least one metal surface is zinc, galvanized iron, or galvanized steel.

* * * * *